US010170058B2

(12) United States Patent
Kang

(10) Patent No.: US 10,170,058 B2
(45) Date of Patent: Jan. 1, 2019

(54) DISPLAY DEVICE WITH TEMPERATURE-BASED CONTROL AND METHOD FOR DRIVING THE SAME

(71) Applicant: SAMSUNG ELECTRONICS CO., LTD., Suwon-si (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 126 days.

(21) Appl. No.: 15/214,048

(22) Filed: Jul. 19, 2016

(65) Prior Publication Data

US 2017/0263194 A1 Sep. 14, 2017

(30) Foreign Application Priority Data

Mar. 10, 2016 (KR) ..... 10-2016-0028912

(51) Int. Cl.
*G09G 3/34* (2006.01)
*G09G 3/36* (2006.01)

(52) U.S. Cl.
CPC ..... *G09G 3/3413* (2013.01); *G09G 3/342* (2013.01); *G09G 3/3406* (2013.01); *G09G 3/3648* (2013.01); *G09G 2310/08* (2013.01); *G09G 2320/0233* (2013.01); *G09G 2320/041* (2013.01); *G09G 2320/0626* (2013.01)

(58) Field of Classification Search
CPC ..... G09G 2310/08; G09G 2320/0233; G09G 2320/041
See application file for complete search history.

(56) References Cited

U.S. PATENT DOCUMENTS 6,292,901 B1 * 9/2001 Lys ..... A61N 5/0616 713/300
2005/0073845 A1 * 4/2005 Matsui ..... H04N 9/315 362/293
2005/0162360 A1 * 7/2005 Ishihara ..... G09G 3/2011 345/89
2005/0168965 A1 * 8/2005 Yoshida ..... G03B 15/05 362/3
2006/0038803 A1 * 2/2006 Miller ..... H05B 33/0815 345/204
2007/0001619 A1 * 1/2007 Kang ..... H05B 33/0815 315/247
2007/0188425 A1 * 8/2007 Saccomanno ..... G09G 3/3406 345/82
2007/0205977 A1 * 9/2007 Kim ..... G09G 3/3406 345/102
2007/0257623 A1 * 11/2007 Johnson ..... H05B 33/0818 315/193
2009/0039860 A1 * 2/2009 Suzuki ..... H04B 10/502 323/312
2011/0122167 A1 * 5/2011 Kim ..... G09G 3/342 345/690

(Continued)

*Primary Examiner* — Chun-Nan Lin
(74) *Attorney, Agent, or Firm* — Sughrue Mion, PLLC

(57) ABSTRACT

A display device and a method for driving the same are provided. The display device includes a light emitter comprising a plurality of light emitting elements connected in parallel to each other, and a driving circuit configured to change an operating state of a part of the plurality of light emitting elements based on temperature detection of switching elements respectively connected to the plurality of light emitting elements.

10 Claims, 10 Drawing Sheets

(56) References Cited

U.S. PATENT DOCUMENTS

2012/0253542 A1* 10/2012 Nurmi ..... H05B 33/0824
700/299
2013/0314064 A1* 11/2013 Theiler ..... G09G 3/3406
323/282

* cited by examiner

DISPLAY DEVICE WITH TEMPERATURE-BASED CONTROL AND METHOD FOR DRIVING THE SAME

CROSS-REFERENCE TO RELATED APPLICATION

This application claims priority from Korean Patent Application No. 10-2016-0028912 filed on Mar. 10, 2016 in the Korean Intellectual Property Office, the disclosure of which is incorporated herein by reference in its entirety.

BACKGROUND

Field

Apparatuses and methods consistent with exemplary embodiments relate to a display device and a method for driving the same, and more particularly, to a display device and a method for driving the same, which can individually control the driving current of a Light-emitting diode (LED) element in accordance with a temperature that is detected for each LED string in a video display device having an LED backlight.

Description of the Related Art

In general, a video display device is used to display a video signal that is input from a video card or the like. Such a video display device may be divided into a self-luminous type and a non-luminous type. For example, a video display device, such as organic light-emitting diode (OLED) or Plasma display panel (PDP), is a self-luminous type, and displays an image through emission of light by itself. In contrast, liquid-crystal display (LCD) is obtained by injecting liquid crystals having intermediate property between solid and liquid between two thin glass substrates, and displays an image in a manner that it changes an alignment of liquid crystal molecules to generate contrast when a power is supplied thereto. As a result, the LCD is of a non-luminance type, and thus is unable to operate if there is no rear surface light source. Accordingly, there is a need for a backlight light source in the form of a surface light source, which can maintain the whole screen with uniform brightness.

The backlight light source may include, for example, a plurality of LEDs, which may be arranged at edge portions of a panel or on the whole rear surface of the panel to provide light as a surface light source. In general, a backlight light source in which LEDs are arranged at edge portions of the panel is called an edge type, and a backlight light source in which LEDs are arranged on the whole rear surface of the panel is called a direct type. Further, the video display device includes a driver for driving the backlight light source, and the driver may include a switching type power circuit that performs on/off driving of the backlight light source.

However, recently, as the size of the video display device is gradually increased, heat generation of the backlight unit causes a problem. In other words, there has been a need to effectively decrease the heat generation while saving the manufacturing cost of the display product.

SUMMARY

Exemplary embodiments address at least the above problems and/or disadvantages and other disadvantages not described above, and provide a display device and a method for driving the same, which can individually control the driving current of an LED element in accordance with a temperature that is detected for each LED string in a video display device having an LED backlight. Also, the exemplary embodiments are not required to overcome the disadvantages described above, and may not overcome any of the problems described above.

According to an aspect of an exemplary embodiment, there is provided a display device including a light emitter comprising a plurality of light emitting elements connected in parallel to each other; and a driving circuit configured to change an operating state of a part of the plurality of light emitting elements based on temperature detection of switching elements respectively connected to the plurality of light emitting elements.

The display device may further include a temperature detector configured to detect temperature of the switching element, wherein the driving circuit is configured to adjust driving current of the part of the light emitting elements based on the temperature detected by the temperature detector.

The driving circuit may increase or decrease in stages the driving current of the part of the light emitting elements based on a plurality of designated temperature setting values in response to changing the temperature of the switching element.

The driving circuit may include a gain controller configured to control a reference current value based on the detected temperature; and a compensator configured to adjust a turn-on level of the switching element based on a difference between the controlled reference current value and a feedback current value of the switching element.

The driving circuit, the temperature sensor, and the switching element may be included in one chip.

The driving circuit may turn off the switching element if the detected temperature of the switching element exceeds a preset threshold value.

The light emitter may generate white light through driving of at least one of red (R), green (G), blue (B), and white (W) light emitting elements among the plurality of light emitting elements.

The driving circuit may individually change the operating state of the plurality of light emitting elements through adjustment of a turn-on level of the switching element.

According to another aspect of an exemplary embodiment, there is provided a method for driving a display device including operating a plurality of light emitting elements connected in parallel to each other; and changing an operating state of a part of the plurality of light emitting elements based on temperature detection of switching elements respectively connected to the plurality of light emitting elements.

The method for driving a display device may further include detecting temperature of the switching element, wherein the changing of the operating state may include adjusting driving current of the part of the light emitting elements based on the temperature detected by a temperature detector.

The changing of the operating state may increase or decrease in stages the driving current of the part of the light emitting elements based on a plurality of designated temperature setting values in response to changing the temperature of the switching element.

The changing of the operating state may include controlling a reference current value based on the detected temperature; and adjusting a turn-on level of the switching element based on a difference between the controlled reference current value and a feedback current value of the switching element.

The changing of the operating state may include turning off the switching element if the detected temperature of the switching element exceeds a preset threshold value.

The operating of the plurality of light emitting elements may include generating white light through driving of at least one of red (R), green (G), blue (B), and white (W) light emitting elements among the plurality of light emitting elements.

The changing of the operating state may include individually changing the operating state of the plurality of light emitting elements by adjusting a turn-on level of the switching element.

Additional and/or other aspects and advantages of the exemplary embodiments will be set forth in part in the description which follows and, in part, will be obvious from the description, or may be learned by practice of the disclosure.

BRIEF DESCRIPTION OF THE DRAWING FIGURES

The above and/or other aspects will be more apparent by describing in detail exemplary embodiments with reference to the accompanying drawings, in which.

DETAILED DESCRIPTION OF THE EXEMPLARY EMBODIMENTS

Hereinafter, exemplary embodiments will be described in detail with reference to the accompanying drawings.

Figure 1:
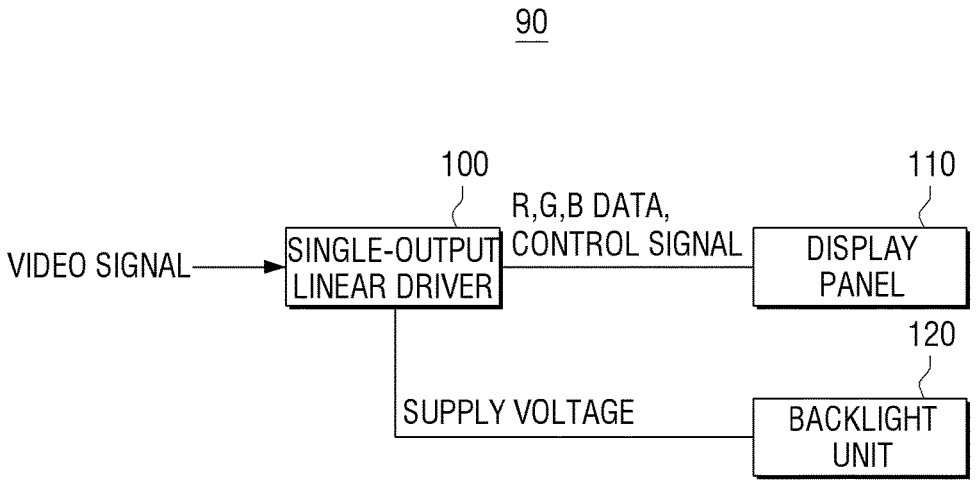
FIG. 1 is a block diagram illustrating the configuration of a display device according to an exemplary embodiment.

FIG. 1 is a block diagram illustrating the configuration of a display device according to an exemplary embodiment.

Referring to FIG. 1, a display device 90 may include a part or the whole of a single-output linear driver (or driving circuit) 100, a display panel 110, and a backlight unit 120.

Here, the term "includes a part or the whole" means that a constituent element such as the single-output linear driver 100 may be integrally constructed into another constituent element such as the display panel 110, and to help understanding, explanation will be made on the assumption that the display device 90 includes the whole of the above-described elements.

The single-output linear driver 100 may control the overall operation of the display device 90. In other words, if the display device 90 is turned on, the single-output linear driver 100 controls the backlight unit 120 to provide light to the display panel 110 so that an input video signal is output through the display panel 110. Here, the video signal may include a video signal, an audio signal, and additional information such as caption information.

The single-output linear driver 100 may include driving circuits that can control driving current for each string (or array) in which a plurality of light emitting elements, for example, a plurality of LEDs, which constitute the backlight unit 120, are connected in series. For this, the single-output linear driver 100 provides a supply voltage Vcc to a string, in which the plurality of LEDs that are connected in series are again connected in parallel to each other, as a common voltage, and controls in stages the driving current of the individual string in accordance with a temperature that is detected from the individual string. It is also possible to control the driving current in groups through detection of the temperatures of the plurality of strings. Here, the term "control in stages" means to set a plurality of temperature sections and to control the driving current of the LEDs so as to provide the driving current corresponding to each of the plurality of temperature sections. The driving current may be obtained through adjustment of turn-on duty rates of the switching elements such as Thin-film transistors (TFTs) that are provided for each of the strings, but in an exemplary embodiment, the control of the driving current may mean to change the turn-on level of the switching element through adjustment of the voltage that turns on the switching element. In an exemplary embodiment, the driving current is gradually increased and decreased in stages according to the temperature change, and thus this may be expressed as "linear" change.

Further, the single-output linear driver 100 may receive and collect state values for the driving current of the strings from the respective driving circuits. The state values may be in various forms, such as in the form of current values or in the form of voltage values. The single-output linear driver 100 may control the levels of the supply voltage that is provided to the respective strings based on the collected state values. For example, if a DC voltage of about 14 V is provided to the respective strings as a common voltage, the single-output linear driver 100 may operate to lower the DC voltage to 12 V.

The single-output linear driver 100 may comprise IC type driving circuits that are provided for the respective LED strings. In other words, the single-output linear driver 100 may include the switching elements provided for each of the strings, a temperature sensor configured to detect the temperature of the switching elements that is caused by heat generated from the switching elements, and a control circuit configured to control the operating state of the switching elements in accordance with the temperature detected by the temperature sensor. Accordingly, the temperature sensor measures the temperature that is caused by the heat, which is generated from the switching elements and is transferred through the IC, in a non-contact manner, and provides the measured temperature value to the control circuit. By the above-described configuration, the single-output linear driver 100 can control the operation of the switching elements through detection of the temperature for each of the LED strings. Further, in the case in which the driving circuit is configured in the form of an IC, the switching elements that control the plurality of strings and the control circuit may be constructed in one IC, and only one temperature sensor may be used to control a group of the plurality of strings. In this case, the use of the temperature sensor can be reduced, and thus the manufacturing cost of the display device can be saved.

The display panel 110 displays an image on a screen under the control of the single-output linear driver 100. In an exemplary embodiment, the display panel 110 may include a liquid crystal layer, but existence/nonexistence of a color filter may not be considered. That is, it is also possible to apply a liquid crystal panel with no color filter. However, in the case of the liquid crystal panel having no color filter, it is preferable that the backlight unit 120 includes red (R), green (G), and blue (B) light emitting elements, for example, red (R), green (G), and blue (B) LEDs. In the case of the display panel having no color filter, an image is displayed in a manner that when an R-frame image is implemented on the display panel 110, only R light emitting elements are turned on, and when a G-frame image is implemented on the display panel 110, the turned-on R light emitting elements are turned off and then the G light emitting elements are turned on.

As described above, the backlight unit 120 may include at least one of R, G, B, and W light emitting elements, and may provide white light or may sequentially provide R, G, and B lights. If the display panel 110 does not include a color filter, it is preferable that the backlight unit 120 is configured to sequentially provide the R, G, and B lights. Further, the backlight unit 120 may be divided into a plurality of regions to be dividedly driven. In other words, it is possible to perform local control for the respective regions, that is, local dimming control of the light emitting elements.

Hereinafter, the single-output linear driver 100, the display panel 110, and the backlight unit 120 as illustrated in FIG. 1 will be described in more detail.

Figure 2:
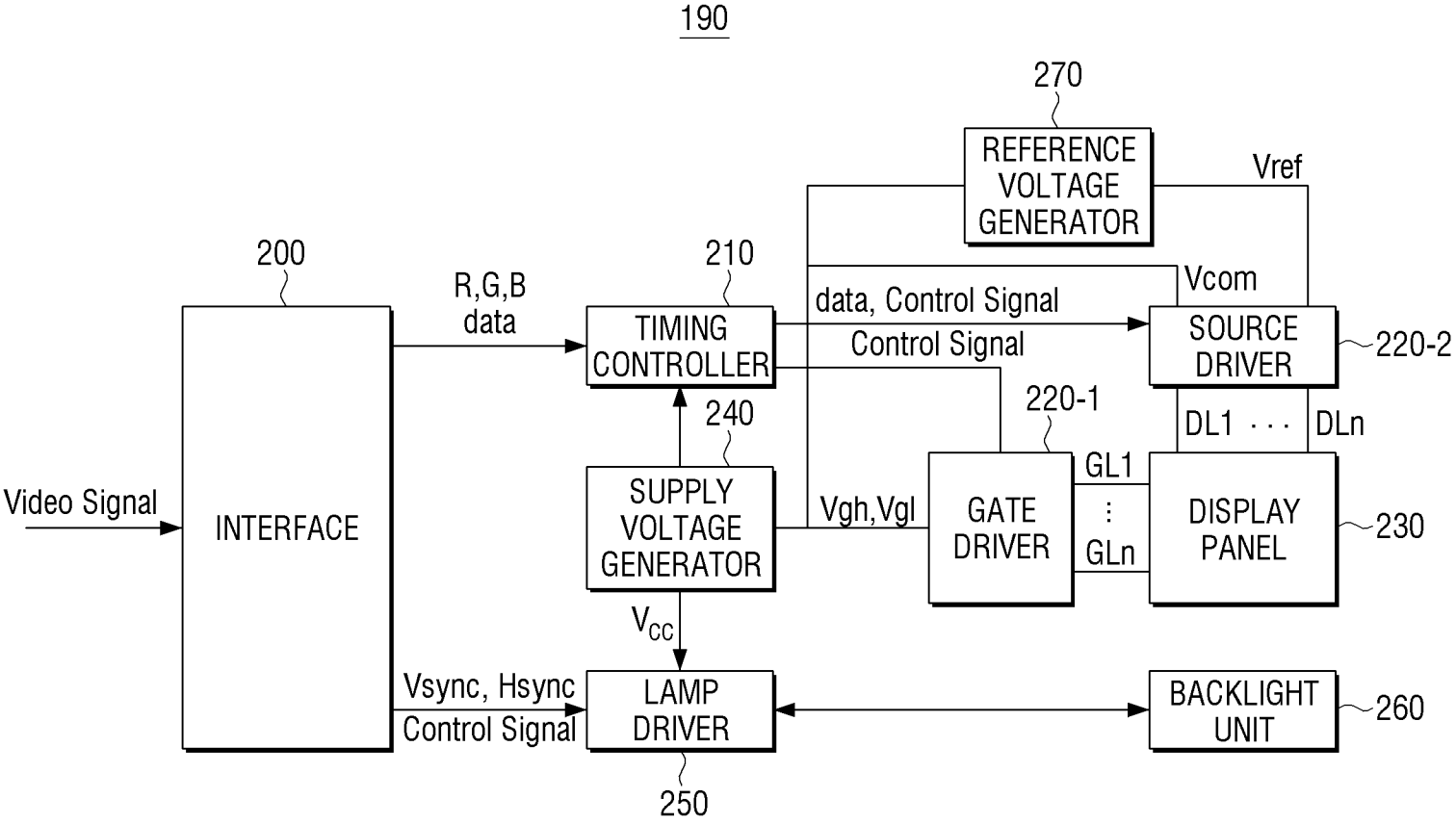
FIG. 2 is a block diagram illustrating the configuration of a display device according to an exemplary embodiment.

FIG. 2 is a block diagram illustrating the configuration of a display device according to an exemplary embodiment.

Referring to FIG. 2, a display device 190 may include a part or the whole of an interface 200, a timing controller 210, gate and source drivers 220-1 and 220-2, a display panel 230, a supply voltage generator 240, a lamp driver 250, a backlight unit 260, and a reference voltage generator 270.

Here, the term "includes a part or the whole" means that partial constituent elements such as the lamp driver 250 and the backlight unit 260 may be integrally constructed to form a backlight unit. To help understanding of the exemplary embodiment, explanation will be made on the assumption that the display device 190 includes the whole of the above-described elements.

The interface 200 is a video board such as a graphic card, and converts video data that is input from an outside to match the resolution of the video display device to output the converted video data. The video data may be, for example, R, G, and B video data of 8 bits, and the interface 200 may generate a clock signal DCLK that matches the resolution of the video display device and control signals, such as vertical and horizontal sync signals Vsync and Hsync. The interface 200 may provide the video data to the timing controller 210, and provide the vertical and horizontal sync signals to the lamp driver 250, so that when an image is implemented on the display panel 230, the backlight unit 260 may be turned on or off in synchronization with the video data.

Further, the interface 200 may include a tuner receiving a specific broadcasting program that is provided from an external broadcasting station, a demodulator demodulating the video signal input through the tuner, a demultiplexer separating the demodulated video signal into video/audio data and additional information, a decoder decoding the separated video/audio data, and an audio processor converting the decoded audio data into a format that matches a speaker.

The interface 200 may further include a video analyzer (not illustrated). The video analyzer may determine the brightness through analysis of the input video signal. Further, the interface 200 may generate a dimming signal in accordance with the brightness, for example, the darkness level, with respect to a continuous unit frame, and provide the dimming signal to the lamp driver 250 as a control signal. Through this, the lamp driver 250 could perform dimming control of the backlight unit 260. It is preferable that the video analyzer is configured to be included in the interface 200, but it may be configured separately from the interface 200. An exemplary embodiment is not specially limited to the above-described contents.

The timing controller 210 provides the video data that is provided from the interface 200 to the source driver 220-2, and controls the video data output from the source driver 220-2 using a timing signal, so that unit frame image is sequentially implemented on the display panel 230. Further, the timing controller 210 controls the gate driver 220-1 to provide a gate on/off voltage that is provided from the supply voltage generator 240 to the display panel 230 by horizontal lines. For example, if a gate voltage is applied to a gate line 1 GL1, the timing controller 210 controls the source driver 220-2 to apply the video data that corresponds to a first horizontal line portion. The timing controller 210 turns on gate line 2 GL2 and turns off the first gate line at the same time so that the video data that corresponds to a second horizontal line portion is applied from the source driver 220-2 to the display panel 230. In this manner, the unit frame image is displayed on the whole screen of the display panel 230.

The gate driver 220-1 receives the gate-on/off voltage Vgh/Vgl from the supply voltage generator 240, and applies the corresponding voltage to the display panel 230 under the control of the timing controller 210. The gate-on voltage Vgh is provided in order from gate line 1 GL1 to gate line N GLn when the image is implemented on the display panel 230.

The source driver 220-2 converts the video data that is provided in series from the timing controller 210 into video data in parallel, converts digital data into an analog voltage, and provides the video data corresponding to one horizontal line portion to the display panel 230 simultaneously or sequentially. Further, the source driver 220-2 may receive a common voltage Vcom that is generated from the supply voltage generator 240 and a reference voltage (or gamma voltage) Vref from the reference voltage generator 270. The common voltage Vcom is provided to a common electrode of the display panel 230, and the reference voltage Vref is provided to a D/A converter in the source driver 220-2 to be used when grayscales of a color image are expressed. In other words, the video data that is provided from the timing controller 210 may be provided to the D/A converter in the source driver 220-2, and digital information of the video data that is provided to the D/A converter is converted into an analog voltage that can express the grayscales of the color image to be provided to the display panel 230.

The display panel 230 may include, for example, a first substrate, a second substrate, and a liquid crystal layer interposed between the first and second substrates. On the first substrate, a plurality of gate lines GL1 to GLn and data lines DL1 to DLn which cross each other to define a pixel region are formed, and a pixel electrode is formed on the pixel region on which the gate and data lines cross each other. Further, on one region of the pixel region, more accurately, at the corner of the pixel region, thin film transistors (TFTs) are formed. When the TFTs are turned on, liquid crystals are twisted, as much as a difference between voltages applied to the pixel electrode of the first substrate and the common electrode of the second substrate, to transmit light from the backlight unit 260.

Further, the display panel 230 may include the gate driver 220-1 and the source driver 220-2 formed on the outline of a display on which an image is implemented. The display panel 230 operates the gate driver 220-1 and the source driver 220-2 according to a timing control signal provided from the timing controller 210, and displays R, G, and B data provided through the source driver 220-2 on the display to implement the image thereon.

The supply voltage generator 240 receives a commercial voltage, that is, AC voltage of 110V or 220V, from the outside, and generates and outputs DC voltages having various levels. For example, the supply voltage generator 240 may generate and provide a voltage of DC 15V for the gate driver 220-1 as the gate-on voltage Vgh, generate and provide a voltage of DC 14V or DC 24V for the lamp driver 250 as the supply voltage Vcc, and generate and provide a voltage of DC 12V for the timing controller 210.

The lamp driver 250 may convert the voltage provided from the supply voltage generator 240 and provide the converted voltage to the backlight unit 260. Here, the term "convert" means both conversion of the analog type DC voltage level and Pulse-width modulation (PWM) driving. Further, the lamp driver 250 may simultaneously or dividedly drive R, G, and B LEDs that constitute the backlight unit 260. The lamp driver 250 may include a feedback circuit that controls feedback of the LED driving current so that uniform light can be provided from the R, G, and B LEDs of the backlight unit 260, and the feedback circuit may be called a switching power circuit. Since the feedback circuit has been fully described while explaining the single-output linear driver 100, the duplicate explanation thereof will be omitted.

The backlight unit 260 may include R, G, and B LEDs. For example, the backlight unit 260 may be constructed in any type, such as a direction type in which the R, G, and B LEDs are arranged on the whole lower end of the display panel 230 or an edge type in which the R, G, and B LEDs are arranged at edges of the display panel 230. However, in an exemplary embodiment, the backlight unit 260 may operate so that the light emitting elements are simultaneously turned on/off or are dividedly driven by blocks under the control of the lamp driver 250. In this case, it is preferable that LEDs that constitute the string or LEDs connected in parallel are individually controlled in accordance with the temperature detected by strings. The plurality of LEDs may be connected in series to each other, or in parallel to each other.

The reference voltage generator 270, or a gamma voltage generator, if a voltage of, for example, DC 10V, is provided from the supply voltage generator 240, may divide the voltage into a plurality of voltages through dividing resistors to provide the divided voltages to the source driver 220-2. The source driver 220-2 may further divide the provided voltages to express 256 grayscales of R, G, and B data.

Through the above-described configuration, heat generation that causes problems on a large-area display panel can be effectively controlled, and thus functionality, that is, performance, of the display device can be maximized.

Figure 3:
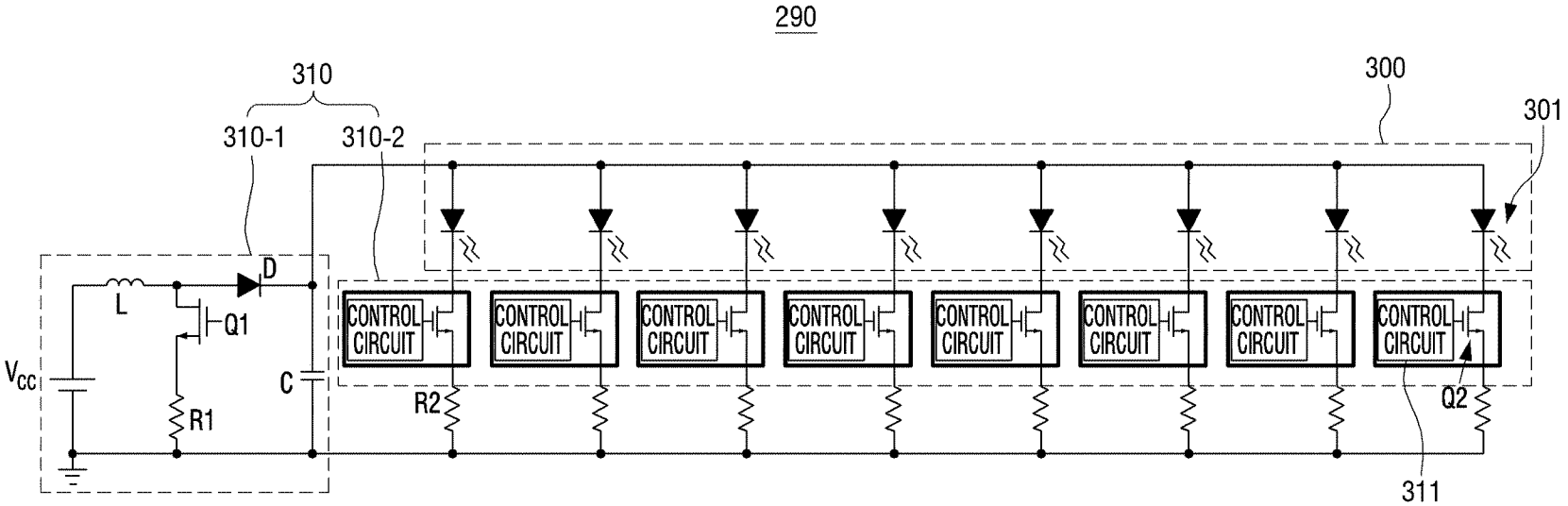
FIG. 3 is a circuit diagram of a display device according to an exemplary embodiment.
Figure 4:
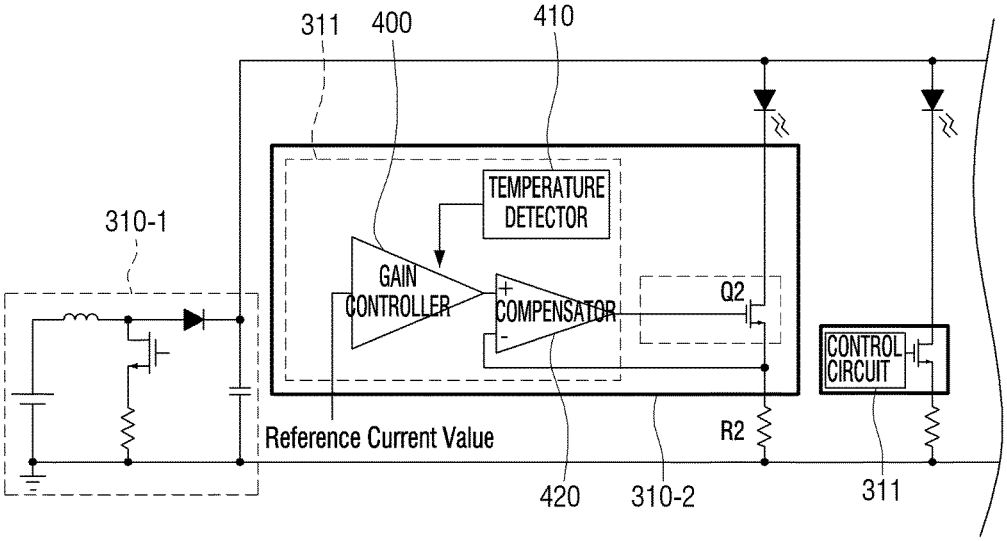
FIG. 4 is a diagram exemplarily illustrating the configuration of the display device of FIG. 3.

FIG. 3 is a circuit diagram of a display device according to an exemplary embodiment, and FIG. 4 is a diagram exemplarily illustrating the configuration of the display device of FIG. 3. FIGS. 5 to 7C are diagrams explaining the operation of a driving circuit illustrated in FIG. 3.

As illustrated in FIG. 3, a display device 290 according to an exemplary embodiment may include a part or the whole of a light emitter (or a light emitting part) 300 and a driving circuit 310.

The light emitter 300 includes light emitting elements 301 that are (electrically) connected in parallel to each other between supply voltage Vcc and ground. Anode terminals of the light emitting elements 301 are commonly connected to commonly receive the supply voltage.

The driving circuit 310 may include a supply voltage generator 310-1 providing the supply voltage to the light emitting elements 301 connected in parallel to each other, and a control circuit 310-2 individually controlling the driving state of the respective light emitting elements 301. Here, only the control circuit 310-2 may be called the driving circuit 310. The control circuit 310-2 may include a switching element Q2 electrically connected to one cathode terminal of the light emitting element 301 and ground, and a control circuit 311 controlling the operation of the switching element Q2.

The control circuit 311 includes a part or the whole of a gain controller 400, a temperature detector 410, and a compensator 420. The gain controller 400 controls (input) reference current gain, that is, a current value, according to the detected temperature to output the controlled current value to the compensator 420. For example, if the temperature is high, the current value is decreased to be provided to the compensator 420, whereas if the temperature is low, the current value is increased to be provided to the compensator 420. In this case, the increase/decrease level corresponds to a gain. Accordingly, the gain controller 400 according to an exemplary embodiment may include an amplifier such as an OP amplifier (Amp), and the compensator 420 may include a comparator.

The temperature detector 410 may include a temperature sensor and peripheral circuits. In an exemplary embodiment, the temperature sensor may differ depending on whether the temperature is detected in contact type or in non-contact type. As a contact type, various sensors, such as a temperature measurement resistor body, thermistor, thermal expansion type sensor, IC temperature sensor, thermocouple sensor, and crystal temperature meter, may be used, and as a non-contact type, various sensor, such as a pyroelectric temperature sensor and quantum temperature sensor, may be used. In an exemplary embodiment, since heat is transferred through the IC, it is preferable to use a contact type temperature sensor.

The compensator 420 may compare the output current value of the gain controller 400 and feedback current from switching element Q2, and adjust the driving state, that is, the turn-on level, of the switching element Q2 according to an error value. Here, the term "turn-on level" does not mean the control of a duty-on time, but means the open level of a gate, that is, gate terminal, through the control of the gate voltage applied to the switching element Q2. As described above, the switching element Q2 operates to gradually increase and/or decrease the open level of the gate terminal in accordance with the temperature change. The compensator 420 may further include a circuit that changes the current value difference to a voltage value.

For example, the supply voltage generator 310-1 boosts the input voltage and charges the boosted voltage in a capacitor C under the control of a switching element Q1. Further, the supply voltage generator 310-1 turns on the switching element Q1 to make the terminal voltage of the resistor R1, more accurately, the remaining voltage obtained by subtracting a diode voltage, stably charged in the capacitor C. Here, the portion related to the switching element Q1 will be described in more detail. The DC voltage that is stably charged in the capacitor C is commonly provided to each light emitting element 301.

Then, the control circuit 311 of the driving circuit 310 controls the switching element Q2 based on the heating temperature of the switching element Q2 measured by the temperature sensor to control the driving current of each light emitting element 301 connected to the corresponding switching element Q2. In this process, the control circuit 311 controls the driving current in stages in accordance with the temperature change. From the viewpoint of the operating state of the light emitting element 301, gradual (slow) lowering or heightening of the driving current may be called "linear". Resistor R1 and resistor R2 correspond to protection resistors that stabilize the voltage.

The control circuit 311 according to an exemplary embodiment detects the temperature that is caused by the heat generation of the LED driving element, that is, switching transistor Q2, and if a protection condition is detected, the control circuit 311 lowers the current that is output to the LED without completely turning off the LED to obtain the possibility to escape from the protection condition, and thus the user's protection condition perception possibility can be minimized. That is, if the detected temperature is equal to or higher than a specific temperature T1, LED current is lowered as the primary protection to reduce the heat generation of the LED driver. If the detected voltage is sufficiently lowered below the specific temperature (or normal temperature) (Treset), the LED current is recovered to the original initial setting current to release the protection.

On the other hand, if the detected temperature is equal to or higher than T1 and is continuously increased to reach a specific temperature threshold value Toff even though the LED current is lowered through the primary protection, the LED is completely turned off as the secondary protection to clearly reduce the heat generation of the LED driving elements. If the detected temperature is sufficiently lowered after the LED is turned off, the protection is released through restoration of the LED current to the initial setting current. In this case, Treset is lower than Toff, and is also lower than T1.

Although it has been exemplified that the protection temperature is divided into two stages, the first protection and the second protection, it may be also possible to divide the protection temperature into much more protection sections and to gradually lower the current as the protection degree is heightened. However, if the temperature is continuously increased, the LED is necessarily turned off at the final stage, and it is preferable that the temperature at which the protection is released is set to be lower than the initial first protection entrance temperature.

Figure 5:
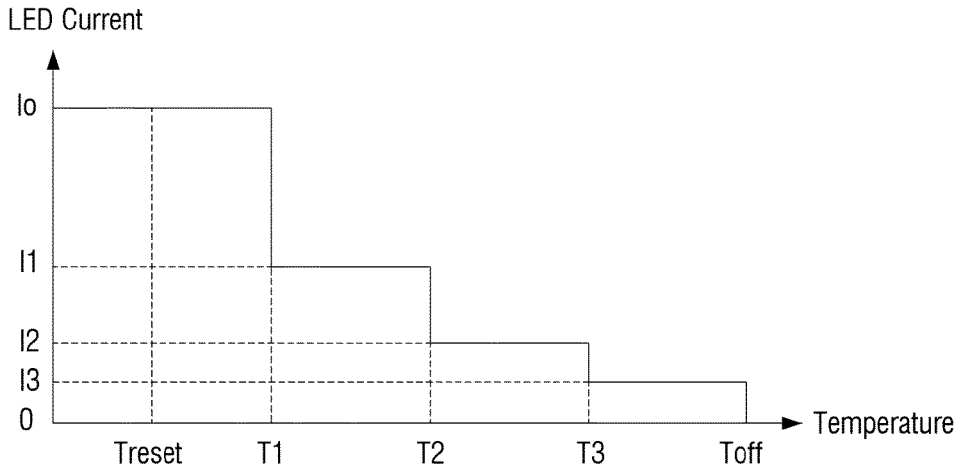
FIGS. 5 to 7C are diagrams explaining the operation of a driving circuit illustrated in FIG. 3.
Figure 6:
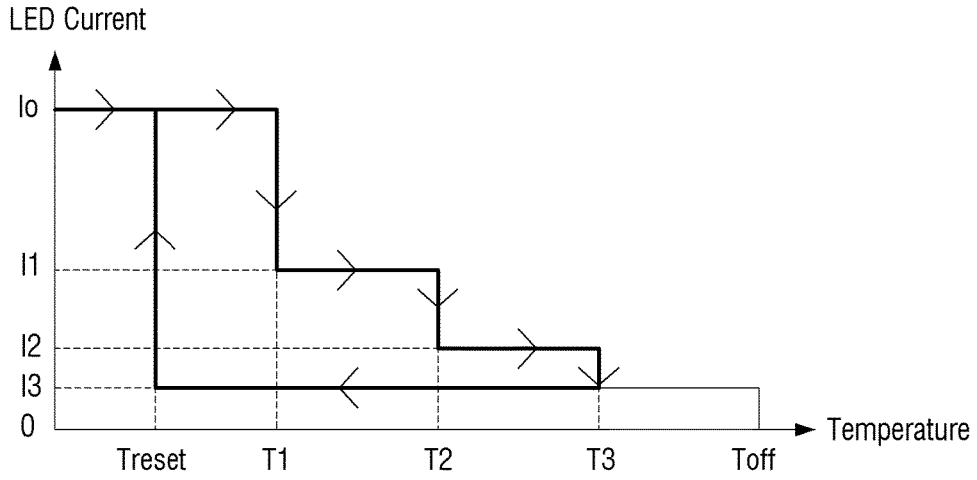

FIG. 5 illustrates an example of four-stage protection to reduce the LED current to four stages according to the temperature, and FIG. 6 illustrates a hysteresis loop in the case in which the temperature is increased up to T3 and then is decreased through the designed protection as illustrated in FIG. 5, so that the protection is finally released.

Referring to FIGS. 6 and 7, Treset is set to be lower than T1 and the LED is necessarily turned off at the final stage in order to prevent the occurrence of thermal runaway that refers to a situation where in accordance with lowering of the LED current, the LED voltage is lowered according to the characteristic of the LED to cause the voltage across both ends of the LED driving element, that is, switching element Q2, to be increased, and thus heat generation of the LED driving element is further increased. In the case in which the protection is once performed due to temporary increase of the surrounding temperature or electric noise, the temperature is lowered, and if the protection is not released on a normal current driving condition after the temperature is sufficiently lowered, it may not be possible to escape from the protection state due to the thermal runaway phenomenon.

Figure 7A:
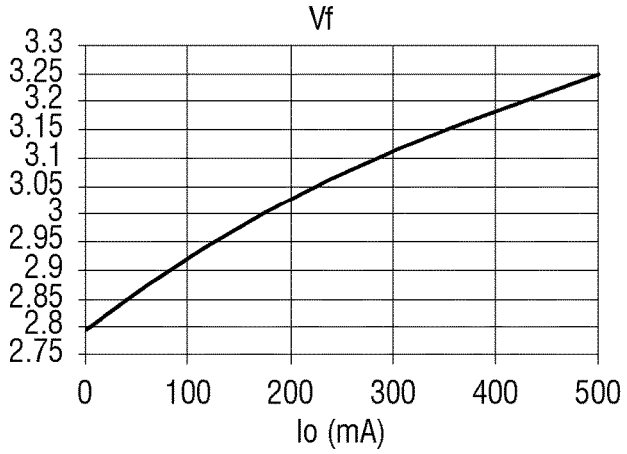
Figure 7B:
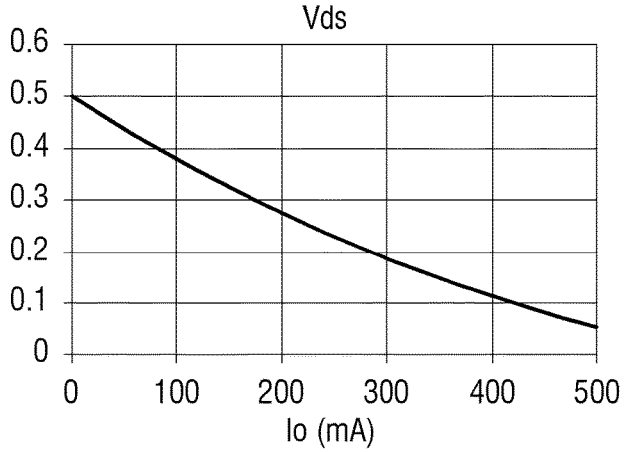
Figure 7C:
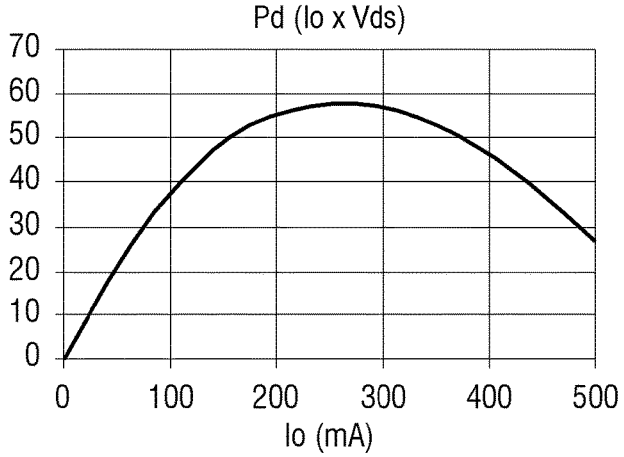

FIGS. 7A to 7C exemplify the current and voltage of the LED and the current and voltage of the LED driving element in the case in which the thermal runaway may possibly occur. As the current is increased, the LED voltage is increased and the voltage of the LED driving element is decreased. In this case, as shown as FIG. 7C, the heat generation of the LED driving element becomes maximum around the current of 250 mA, and thereafter, heat generation is reduced as the current is decreased or increased. If it is assumed that a normal operating current is 450 mA, the thermal runaway in which heat generation is increased as the current is decreased occurs at the current of 250 mA or more.

Considering this, it is preferable that a designer of the display device designs the control circuit 311 of FIG. 3 according to an exemplary embodiment in consideration of the thermal runaway as shown in FIGS. 7A to 7C.

Figure 8:
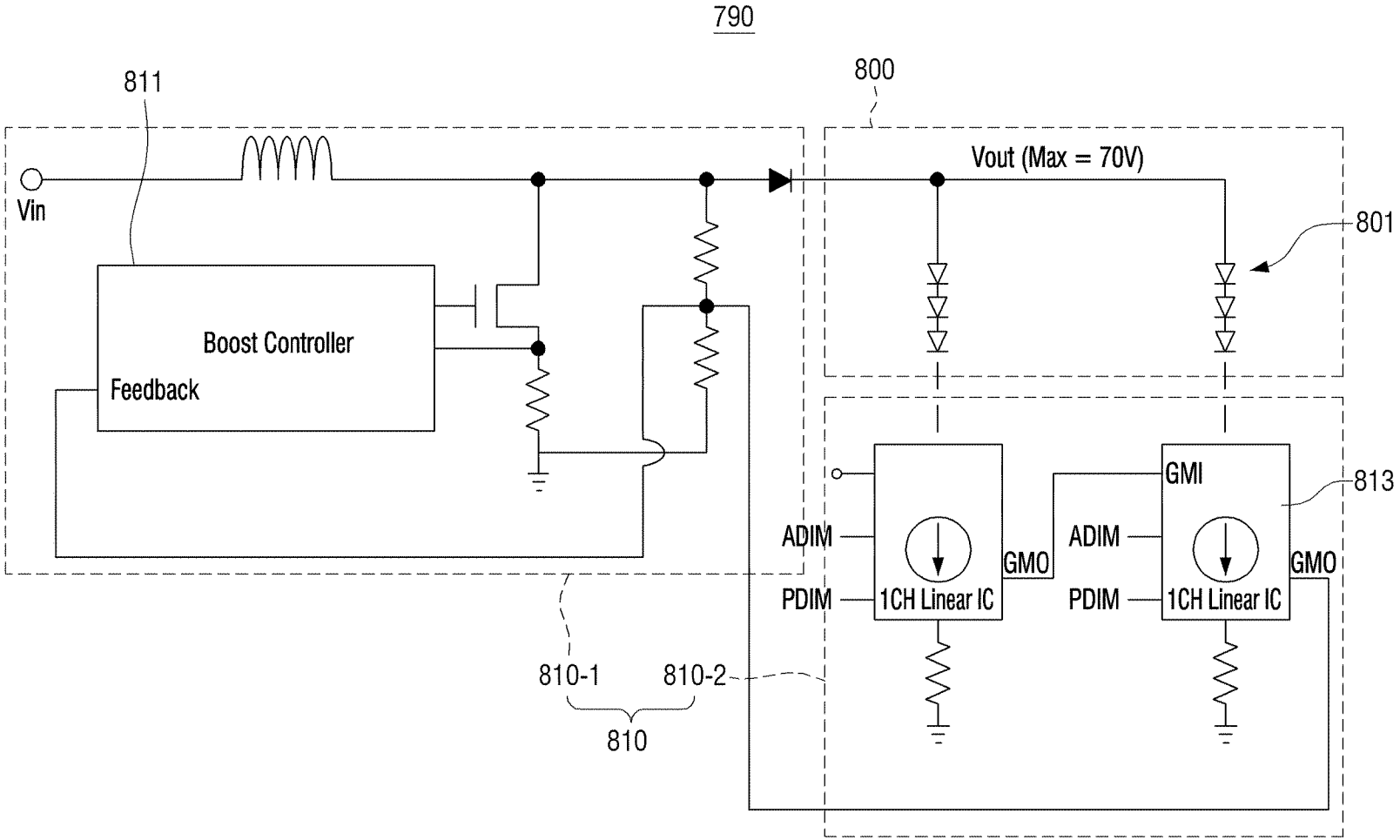
FIG. 8 is a circuit diagram of a display device according to an exemplary embodiment.
Figure 9:
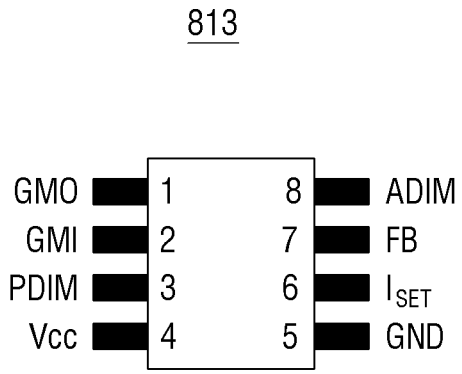
FIG. 9 is a diagram exemplarily illustrating a driving circuit IC of FIG. 8.

FIG. 8 is a circuit diagram of a display device according to an exemplary embodiment, and FIG. 9 is a diagram exemplarily illustrating a driving circuit IC of FIG. 8.

As illustrated in FIG. 8, a display device 790 according to an exemplary embodiment may include a part or the whole of a light emitter 800 and a driving circuit 810.

As compared with the display device 290 as illustrated in FIG. 3, the display device 790 as illustrated in FIG. 8 is different from the display device 290 of FIG. 3, on the point that a plurality of light emitting elements 811 are connected in series to each other to form one string, and a supply voltage generator 810-1 can control the supply voltage provided to the light emitter 800 through collection of data provided from the IC type driving circuit 810.

In this case, the IC type driving circuit 810 may be obtained by forming the switching element Q2 on a single chip as illustrated in FIG. 3. The driving IC 813 illustrated in FIG. 9 corresponds to a one-channel driver, and has the advantages that temperature protection is possible, but short circuit protection (SCP) is not necessary, and it is compatible with a DC/DC converter.

In FIG. 9, GMO denotes a low-level feedback regulation output, GMI denotes a previous feedback regulation input, and PDIM denotes a PWM dimming input. Further, Vcc denotes a power supply input, GND denotes ground, ISET denotes LED current setting, and FB denotes LED feedback. Further, ADIM denotes LED current setting terminal through an external DC voltage.

According to an exemplary embodiment, one control block and one LED driving element (e.g., TFT or TR) are built in the LED driving IC, and thus heat dissipation performance that is equivalent to that of a linear LED driving circuit having an external LED driving element can be secured.

Further, by directly detecting the temperature of the LED driving element, it is possible to discriminate an optimum protection condition, and by detecting no voltage of the LED driving element, voltage internal resistance is minimized to minimize the cost of the IC.

Further, by giving an opportunity to escape from the protection through lowering of the brightness in stages without turning off the LED in the protection condition, possibility that a user perceives the protection is minimized to contribute to the quality improvement.

In addition, in the final stage of protection, the LED is turned off to prevent trouble occurrence due to thermal runaway, and the normal current operation is performed when the protection is released through lowering of the protection release temperature in comparison to the initial production entrance temperature to prevent the protection state from being fixed due to the thermal runaway of the LED driving element.

Through the above-described effects, it is possible to finally implement a linear LED driving circuit having high functionality, low material cost, and optimum protection.

Figure 10:
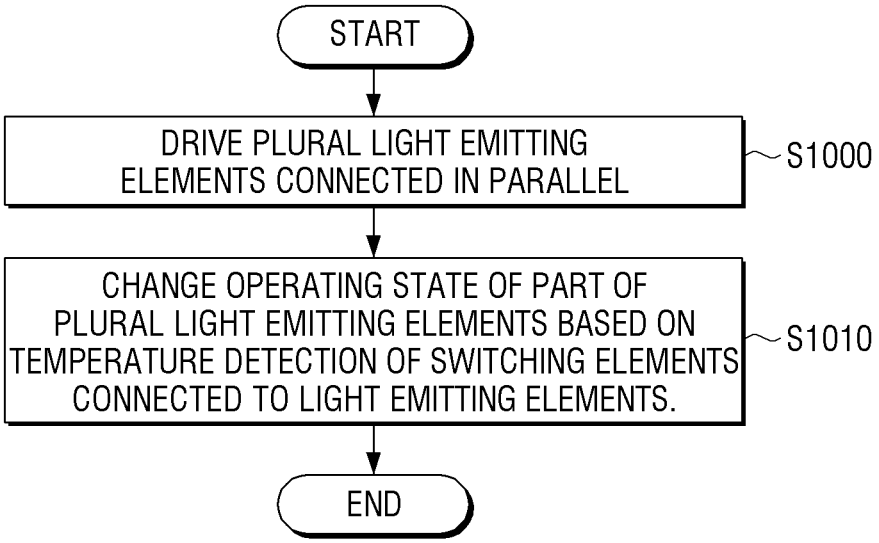
FIG. 10 is a flowchart illustrating a process of driving a display device according to an exemplary embodiment.

FIG. 10 is a flowchart illustrating a process of driving a display device according to an exemplary embodiment.

Referring to FIG. 10 together with FIG. 3, a display device 290 according to an exemplary embodiment drives a plurality of light emitting elements connected in parallel (operation S1000). For example, a supply voltage is applied to the plurality of light emitting elements connected in parallel to turn on the plurality of light emitting elements. Accordingly, the plurality of light emitting elements may provide, for example, white light. As described above, the white light can be obtained by a combination of any one of R, G, B, and W light emitting elements.

Then, the display device 290 changes the operating state of a part of the plurality of light emitting elements based on temperature detection of switching elements connected to the plurality of light emitting elements (operation S1010). Here, the term "changes the operating state of a part" includes not only individual change of the operating states of the respective light emitting elements but also change of a group of the plurality of light emitting elements. In this case, the control is to adjust the turn-on level of the switching element, and the operating state of the light emitting element is changed through adjustment of the driving current of the light emitting element. In other words, the control includes making of the voltage VGS that is applied between a gate and a source of the switching element, for example, TFT, adjustment of the turn-on section, that is, duty-on time, and change of the level of the VGS.

Although it is exemplified that the temperature of the switching element is detected through the IC type configuration, it is also possible to detect the temperature according to an air contact type even in the case of constructing a partition for each string. Accordingly, the exemplary embodiment is not specially limited to the IC type formation.

In addition, the IC is not constructed for each string, but the driving circuits that control two or three strings can be formed into one chip with one temperature sensor to perform the group control. Accordingly, the exemplary embodiment is not specially limited to what type of IC is formed.

The foregoing exemplary embodiments and advantages are merely exemplary and are not to be construed as limiting the present disclosure. Also, the description of the exemplary embodiments is intended to be illustrative, and not to limit the scope of the claims, and many alternatives, modifications, and variations will be apparent to those skilled in the art.

What is claimed is:

1. A display device comprising:

a light emitter comprising a plurality of light emitting elements connected in parallel to each other;

a plurality of switching elements, respectively connected to the plurality of light emitting elements;

a plurality of temperature sensors, respectively configured to detect a temperature of the plurality of switching elements; and a driving circuit configured to:

control a turn-on level of each of the plurality of switching elements based on the detected temperature, and adjust a driving current of each of the plurality of light emitting elements based on the turn-on level of a respective switching element connected thereto;

wherein the driving circuit comprises:

a gain adjuster configured to adjust a reference current value based on the detected temperature; and a compensator configured to adjust the turn-on level of the respective switching element based on a difference between the adjusted reference current value and a feedback current value of the respective switching element.

2. The display device as claimed in claim 1, wherein the driving circuit is further configured to increase or decrease, in stages, the driving current of each of the plurality of light emitting elements by changing the turn-on level of the respective switching element, based on a plurality of designated temperature setting values in response to a temperature of the respective switching element being changed.

3. The display device as claimed in claim 1, wherein the driving circuit is further configured to turn off each of the plurality of switching elements if the detected temperature of the switching element exceeds a preset threshold value.

4. The display device as claimed in claim 1, wherein the light emitter generates white light through driving of at least one of red (R), green (G), blue (B), and white (W) light emitting elements among the plurality of light emitting elements.

5. The display device as claimed in claim 1, wherein the driving circuit is configured to individually adjust the driving current of each of the plurality of light emitting elements by adjusting the turn-on level of the respective switching element.

6. A method for driving a display device, the method comprising:

operating a plurality of light emitting elements connected in parallel to each other;

controlling a turn-on level of a respective switching element, of a plurality of switching elements respectively connected to the plurality of light emitting elements, based on a detected temperature of the respective switching element; and adjusting a driving current of each of the plurality of light emitting elements based on the turn-on level of a respective switching element, of the plurality of switching elements;

wherein the controlling the turn-on level comprises:

adjusting a reference current value based on the detected temperature; and adjusting the turn-on level of the respective switching element based on a difference between the adjusted reference current value and a feedback current value of the respective switching element.

7. The method as claimed in claim 6, wherein the controlling the turn-on level comprises increasing or decreasing, in stages, the driving current of each of the plurality of light emitting elements, based on a plurality of designated temperature setting values in response to the temperature of the respective switching element being changed.

8. The method as claimed in claim 6, wherein the controlling the turn-on level comprises turning off the respective switching element if the detected temperature of the respective switching element exceeds a preset threshold value.

9. The method as claimed in claim 6, wherein the operating of the plurality of light emitting elements comprises generating white light through driving of at least one of red (R), green (G), blue (B), and white (W) light emitting elements among the plurality of light emitting elements.

10. The method as claimed in claim 6, wherein the changing the turn-on level comprises individually adjusting the driving current of the plurality of light emitting elements by adjusting the turn-on level of the respective switching element.

* * * * *